United States Patent [19]

Kessie

[11] Patent Number: 4,888,102

[45] Date of Patent: Dec. 19, 1989

[54] ELECTROLYTIC CELL WITH REFERENCE ELECTRODE

[75] Inventor: Robert W. Kessie, Naperville, Ill.

[73] Assignee: The United States of America as represented by the United States Department of Energy, Washington, D.C.

[21] Appl. No.: 225,411

[22] Filed: Jul. 28, 1988

[51] Int. Cl.[4] ..... C25C 3/34; C25C 7/00

[52] U.S. Cl. ..... 204/231; 204/1.5; 204/243 R; 204/420; 204/435

[58] Field of Search ..... 204/435, 420, 231, 243 R, 204/1.5

[56] References Cited

U.S. PATENT DOCUMENTS

| | | | |
|---|---|---|---|
| 2,755,243 | 7/1956 | Beckman et al. | 204/435 X |
| 3,551,315 | 12/1970 | Friconneau et al. | 204/420 X |
| 3,930,976 | 1/1976 | Owen | 204/420 |
| 4,016,063 | 4/1977 | Radnoti | 204/420 |
| 4,596,647 | 6/1986 | Miller et al. | 204/212 |

FOREIGN PATENT DOCUMENTS

| | | | |
|---|---|---|---|
| 903905 | 10/1945 | France | 204/420 |

*Primary Examiner*—G. L. Kaplan

*Attorney, Agent, or Firm*—William Lohff; James W. Weinberger; Judson R. Hightower

[57] ABSTRACT

A reference electrode device is provided for a high temperature electrolytic cell used to electrolytically recover uranium from spent reactor fuel dissolved in an anode pool, the device having a glass tube to enclose the electrode and electrolyte and serve as a conductive membrane with the cell electrolyte, and an outer metal tube about the glass tube to serve as a shield and basket for any glass sections broken by handling of the tube to prevent their contact with the anode pool, the metal tube having perforations to provide access between the bulk of the cell electrolyte and glass membrane.

6 Claims, 4 Drawing Sheets

ELECTROLYTIC CELL WITH REFERENCE ELECTRODE

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

This invention relates to reference electrodes for use in high temperature environments which may involve high thermal shock conditions and more particularly to reference electrodes with protective structures over the electrode membranes. Specifically, the invention relates to reference electrodes useful in mixed halide salts as high temperature electrolytes in electrolytic cells for the electrorefining of spent reactor fuels.

In the electrorefining of two or more metals involving the selective deposition of at least one of the metals, a reference electrode is useful as a standard potential in the study of the process and to control the cathode potential without dependence on changing anode potentials. Control of the cathode potential is important in determining which metal of the metal mixture is being deposited on the cathode at a particular stage of the process. One new reactor system under development and evaluation by the U.S. Department of Energy involves the use of a metal fuel of U-Pu-Zr. Processing of spent fuel is carried out electrolytically during which U and Pu may be separately deposited on the cathode. The cell electrolyte is a mixed halide salt and the cell operating temperature is in the order of about 500° C. The anode is a pool of liquid cadmium with the spent fuel below the electrolyte in the cell. The cell is operated in an inert atmosphere of argon with less than 2 ppm of water vapor and less than 2 ppm of oxygen. An earlier version of the cell is disclosed in U.S. Pat. No. 4,596,647 which is hereby incorporated herein by reference.

The reference electrode previously utilized and tested in the experimental electrolytic cell has been an alumina tube with a small hole drilled in the bottom for ionic access between the cell electrolyte and the electrolyte of the reference electrode. The reference electrode was based on a Ag/AgCl electrode with added electrolyte usually having the same composition as the nonreactive components of the main salt electrolyte of the electrolytic cell. The silver electrode was a wire with a lower end formed into a small coil or helix and was primarily retained in the tube except for an exposed upper end section for electrical connection. In general, this reference electrode had a large drift rate and required frequent regeneration by an anodizing step. These problems appeared to be due to a diffusive transport of silver chloride through the small opening (although packed with yttria fiber) at the lower end of the reference electrode.

Accordingly, one object of the invention is an electrolytic cell with a reference electrode operable for an extendable period of time at temperatures in the order of 500° C. A second object of the invention is an electrolytic cell with a reference electrode operable in the cell containing a molten chloride salt electrolyte and a liquid metal anode pool containing uranium, plutonium, zirconium, sodium and other metals. Another object of the invention is a reference electrode with a glass electrode which is usable in a high thermal shock environment. These and other objects will be readily apparent from the following description.

SUMMARY OF THE INVENTION

Briefly, the invention is directed to a reference electrode device for mounting in a housing of an electrolytic cell and extending into an electrolyte layer in the interior of the cell, the device comprising an elongated glass tube extending from the housing into the interior of the cell and having a lower closed-ended section with ionic conductivity for exposure to the cell electrolyte, a metal electrode supported in the glass tube and in separated juxtaposition with the closed end, an electrolyte in the lower section in contact with the electrode, and an electrical insulator separating the electrode and glass tube. The reference electrode device of the invention further includes an elongated metal tube extending from the housing over the glass tube as a protective shield or cover and basket with the metal tube having a perforated side wall in contact with the cell electrolyte and means are provided for supporting the glass tube within the metal tube, and for supporting the metal tube in the cell housing. The one-piece glass tube provides physical isolation of the electrode and inner electrolyte from the cell electrolyte while serving as a membrane while the metal tube provides a shield and basket over the glass tube. Under the conditions of high temperature, motion of the rotating stirrer in the cell electrolyte and other operating conditions in the cell, the elongated glass membrane may be subject to breakage. If glass from a broken membrane is allowed to come in contact with a uranium-containing anode pool, the amount of uranium available for transfer to the cathode will become depleted by the formation of uranium dioxide. Accordingly, the metal tube is designed to provide protection to the glass tube while also serving as a basket to collect separate glass sections of the tube before they would fall into the cell electrolyte and subsequently into a lower anode pool. Perforations in the side wall of the metal tube permit access between the glass membrane and cell components.

DETAILED DESCRIPTION OF THE PREFERRED EMBODIMENT

The reference electrode of the invention is particularly useful in high temperature electrolytic cells where glass membrane sections may be broken during removal or replacement operations in the top cover or lid of the cell housing or by thermal shock at the high temperatures. These cells usually include a cell housing of a rigid metal construction containing a salt electrolyte and a pair of electrodes. In one experimental cell for the recovery of uranium from a mixture of metals where the reference electrode has been tested, the cell interior includes a mixed halide salt as the electrolyte over a cadmium pool as the anode with the cathode being a solid metal rod suspended into the electrolyte. The design further includes a motor for rotating the cathode and devices for separately stirring the electrolyte and anode pool. The operating temperature for the cell is usually in the order of about 500° C. The cell and reference electrode of the invention operate in an inert atmosphere of argon with less than 2 ppm of water vapor and less than 2 ppm of oxygen.

Figure 1:
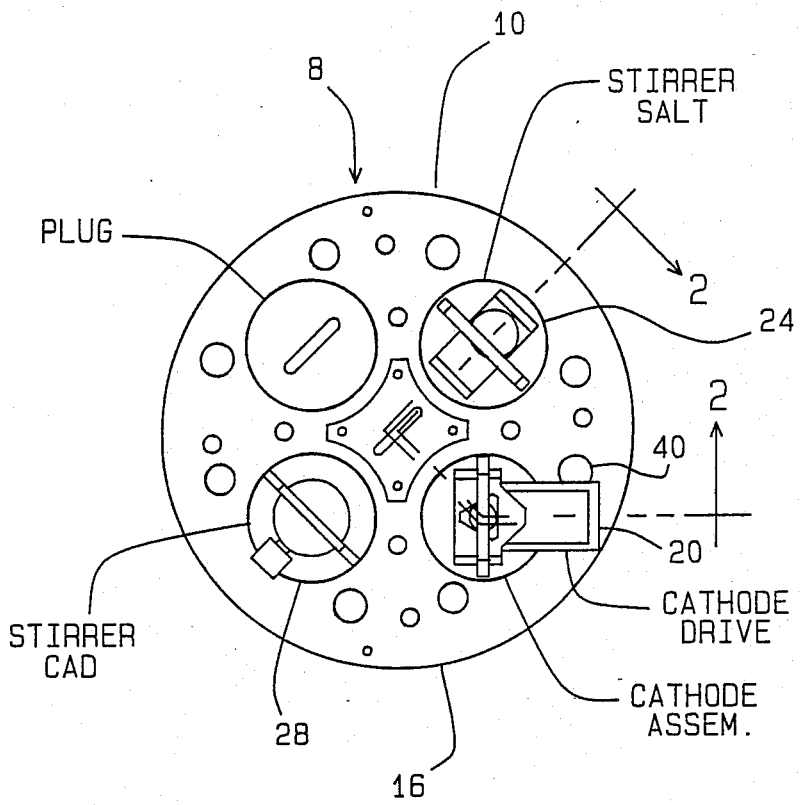
FIG. 1 is a top view of an electrolytic cell with various cell components including a reference electrode.
Figure 2:
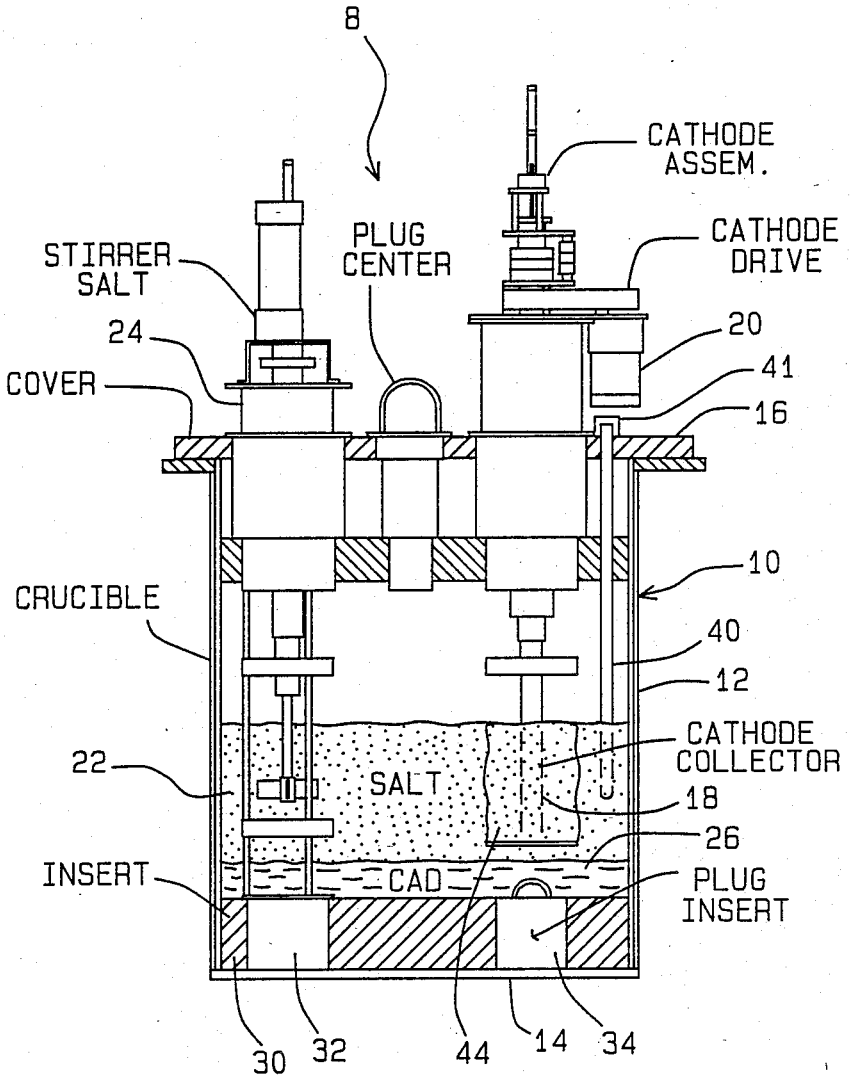
FIG. 2 is a side sectional view of the cell of FIG. 1 taken along line 2—2' showing a reference electrode.

A top and sectional side view of a cell 8 of this type is illustrated in FIGS. 1 and 2. The cell housing 10 includes circular side wall 12, bottom 14 and upper cover 16 which serves to support drives for cathode rotation, electrolyte stirring and anode stirring. As illustrated, the cathode 18 of low carbon steel is rotated by drive 20 while the electrolyte 22 is stirred by drive 24. Electrolyte 22 is composed of a mixture of alkali and/or alkaline earth metal chlorides such as Li, K, Ba and the like and preferably is a mixture of LiCl and KCl in a mole ratio of about 3:2. Stirring of the cadmium pool 26 is provided by motor drive 28. In general the drives are operated at speeds in the order of 100–200 rpm. The construction of housing 10 is low carbon steel. An iron insert 30 and plug inserts 32 and 34 are provided to adjust the cadmium to the desired level in the housing while permitting some excess capacity to the extent desired.

FIGS. 1 and 2 also include reference electrode 40 mounted in cover 16 and extending down into electrolyte 22. Advantageously, reference electrode 40 is positioned near cathode 18 but separated a distance to avoid being struck by the rotating metal deposition 44 on the cathode. As illustrated, reference electrode 40 includes an upper cover 41 to prevent contaminants from falling into the electrode. The cell temperature is in the order of about 500° C. which is provided by an electric furnace (not shown).

The reference electrode of the invention is useful for mounting in a housing of an electrolytic cell and extending into an electrolyte layer in the interior of the cell, the device comprising an elongated glass tube of one-piece construction extending from the housing into the interior of the cell and having a lower closed-ended section with ionic conductivity for exposure to the cell electrolyte, a metal electrode supported in the glass tube and in separated juxtaposition with the closed end, an electrolyte in the lower section in contact with the electrode, and an electrical insulator separating the electrode and glass tube. The device further includes an elongated metal tube extending from the housing over the glass tube as a protective cover and basket with the metal tube having a perforated side wall in contact with the cell electrolyte, and means are provided for supporting the glass tube within the metal tube and for supporting the metal tube in the cell housing.

Advantageously, the metal tube is electrically isolated from the cell housing to reduce the adverse effect of cell voltages and currents on the operation of the reference electrode. It is also important that means are provided for supporting and electrically insulating the electrode from the glass tube and an alumina tube may be advantageously used for that purpose. A further feature of advantage is a removable cover over the upper open end of the glass tube to prevent contamination of the contents of the tube.

Figure 3:
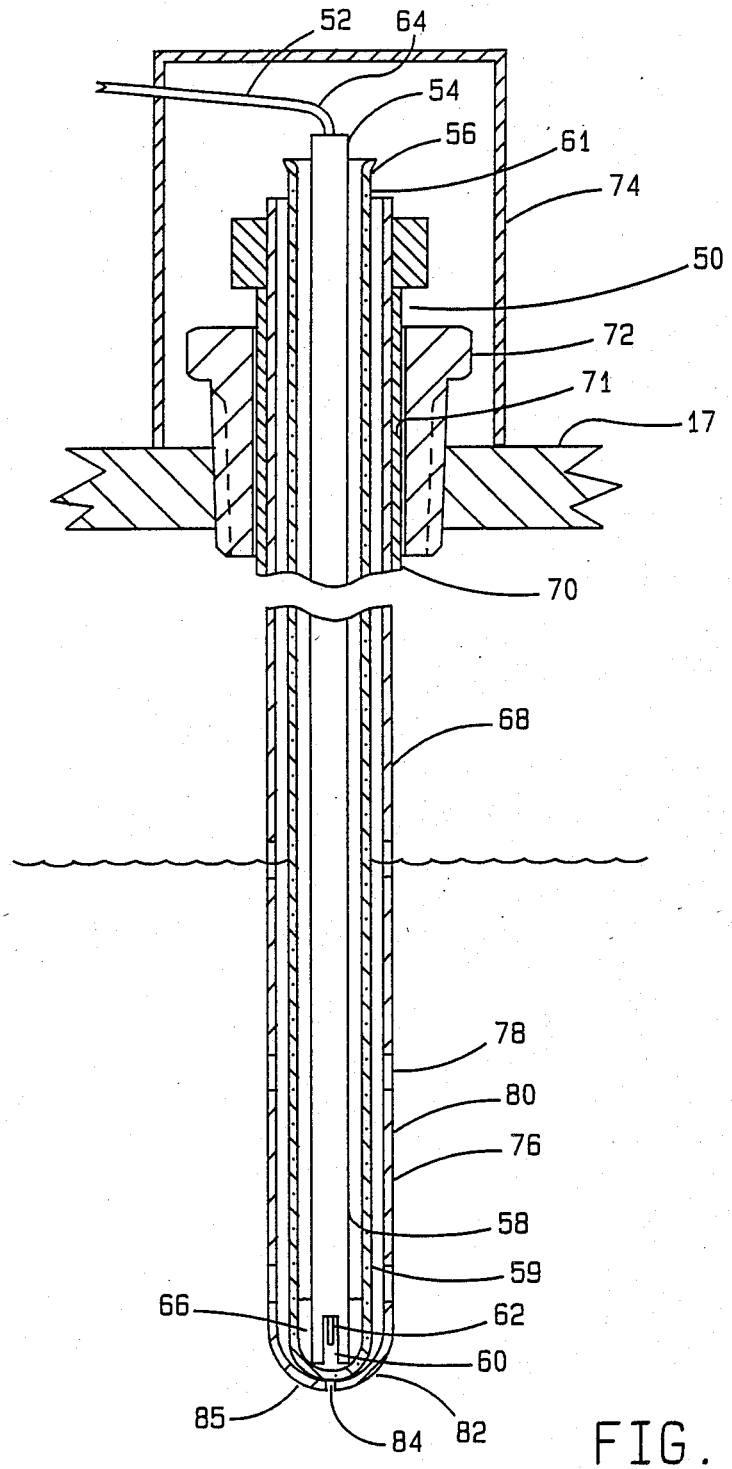
FIG. 3 is a sectional side view of a reference electrode as one embodiment of the invention.

FIG. 3 represents a sectional side view of a reference electrode 50 enlarged to provide additional detail. As illustrated, reference electrode 50 includes an inner electrode of silver wire 52 supported in an alumina tube 54 which isolates electrode 50 from glass tube 56. Retention of electrode 52 in the alumina tube is provided by slot 60 in the lower end 58 of tube 54 which serves to capture a looped bent portion 62 of the electrode. The upper end 64 of the electrode is also bent to prevent the electrode from moving downward in the tube. An electrolyte 66 composed of AgCl plus a mixture advantageously of the cell electrolyte such as LiCl and KCl is also in the tube.

Advantageously, glass tube 56 is constructed of a high strength glass having a high silica content which will include a small alkali metal content for ionic conductivity or have the property of absorbing sufficient salt from the electrolyte for the desired conductivity. Suitably, the glass has a silica content above about 90 wt. % and preferably a content in the order of 96 wt. %. Advantageously, the glass may be a type identified by the trademark "Vycor" from Corning Glass Works of Corning, N.Y. having a silica content of about 96 wt. % with the remaining percentage consisting essentially of $B_2O_3$, $Al_2O_3$ and compounds of Na and Fe. Quartz glass may also be used. Tube 68 is constructed of low carbon steel and is designed to extend over glass tube 56 as a shield and basket. An insulating sleeve 70 of alumina is positioned over a portion 71 of tube 68 to electrically isolate tube 68 from the cell housing 10. Nut 72 is bonded to the alumina sleeve 70 and threaded to mount the device in the cover 17 of a cell housing. A cover 74 is also provided over the reference electrode 50 to prevent contamination of the electrode and electrolyte in the glass tube 56.

Figure 4:
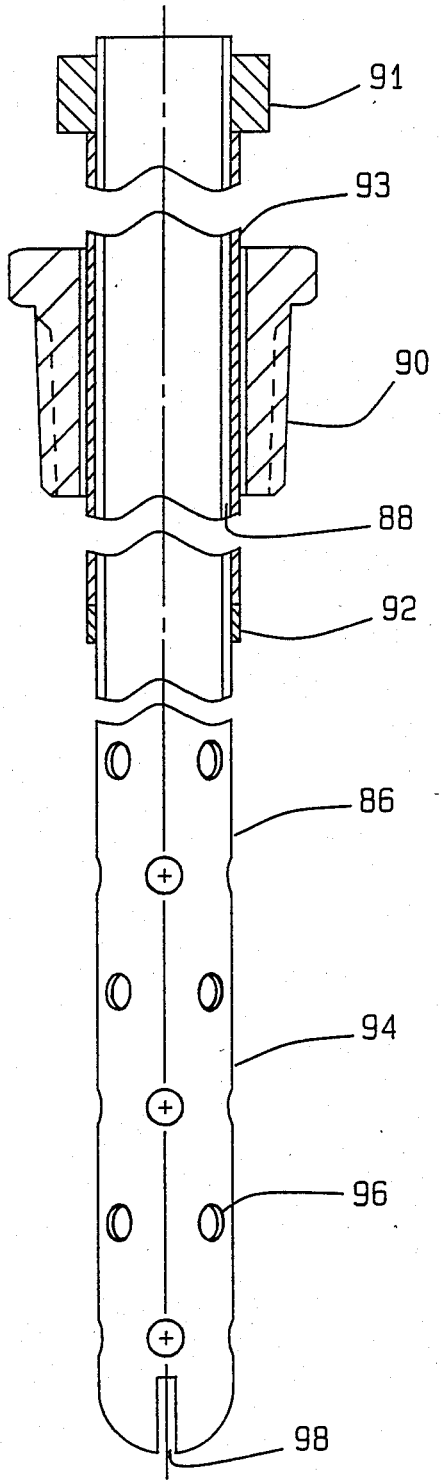
FIG. 4 is a side view of the protective metal tube showing perforations in the side walls.

As illustrated in FIGS. 3 and 4, metal tube 68 includes a lower section 76 with small perforations 78 in the order of about ⅛ inch in diameter along lower wall 80. Slot 84 at curved end 82 is provided for ease of fabrication from open-ended tube material, although the spring fingers 85 also provide some resiliency and support glass tube 56. Slot 84 is a limited opening of about 1/16th inch and effectively prevents the loss of the usual large glass sections from a damaged glass tube. As illustrated, glass tube 56 is of one-piece construction and extends into the interior of the housing with a lower end section 59 being supported by curved end 82 of metal tube 68 to provide a slight compression on the glass. The upper section 61 of glass tube 56 may rest against metal tube 68 since clearance (i.e., about 1/16") is small or may be positioned upright in metal tube 68.

An additional detail of a metal tube 86 is provided in FIG. 4 which includes upper section 88 with nut 90 and upper and lower rings 91 and 92 for support of the alumina tube. In addition, metal tube 86 includes lower section 94 with perforations 96 and lower slot 98.

The foregoing description of embodiments of the invention has been presented for purposes of illustration and description. It is not intended to be exhaustive or to limit the invention to the precise form disclosed, and obviously many modifications and variations are possible in light of the above teaching.

The embodiments of the invention in which an exclusive property or privilege is claimed are defined as follows:

1. An electrolytic cell comprising a housing, an anode, cathode and reference electrode and adapted to contain a molten-salt electrolyte above said anode, wherein said reference electrode comprises an elongated glass tube of one-piece construction extending from said housing into the interior of said cell and having a lower closed-ended section with ionic conductivity, a metal electrode supported in the glass tube and in separated juxtaposition with the closed end, an electrolyte in the lower section in contact with the electrode and an electrical insulator physically separating the electrode and glass tube; an elongated metal tube extending from the housing over the glass tube as a protective cover and basket, the metal tube having a perforated side wall adapted to be in contact with the cell electrolyte and being closed-ended with respect to collecting any broken glass from the glass tube so as to act as a basket to minimize the amount of broken glass from otherwise falling through the electrolyte into the anode; means for supporting the glass tube within the metal tube and means supporting the metal tube in the cell housing.

2. The device of claim 1 including a removable cover positioned over the upper end of the glass tube above the housing.

3. The device of claim 1 wherein the supporting means for the metal tube includes means for electrically insulating the metal tube from the housing.

4. The device of claim 1 wherein the insulator for the electrode includes means for supporting the electrode in the glass tube.

5. The device of claim 4 wherein the insulator includes a lower end section with at least one end slot in which the electrode extends to prevent removal of the electrode apart from the insulator.

6. The device of claim 5 wherein the electrode is silver, the electrolyte within the glass tube is a mixed salt of AgCl and alkali and/or alkaline earth metal chlorides, and the metal tube is of ferrous metal.

* * * * *